US007169993B2

(12) United States Patent
Fliegel et al.

(10) Patent No.: US 7,169,993 B2
(45) Date of Patent: Jan. 30, 2007

(54) DEVICE FOR SECURING THE REED ON THE MOUTHPIECE OF A MUSICAL INSTRUMENT

(75) Inventors: Erwin Fliegel, Alling (DE); Günther Fliegel, Mendorf (DE)

(73) Assignee: Phonosound Musikproduktions GmbH, Alling (DE)

( * ) Notice: Subject to any disclaimer, the term of this patent is extended or adjusted under 35 U.S.C. 154(b) by 282 days.

(21) Appl. No.: 10/433,195

(22) PCT Filed: Nov. 30, 2001

(86) PCT No.: PCT/DE01/04481

§ 371 (c)(1),
(2), (4) Date: May 29, 2003

(87) PCT Pub. No.: WO02/45070

PCT Pub. Date: Jun. 6, 2002

(65) Prior Publication Data

US 2004/0011183 A1 Jan. 22, 2004

(30) Foreign Application Priority Data

Nov. 30, 2000 (DE) ..... 100 59 752

(51) Int. Cl.
*G10D 9/02* (2006.01)

(52) U.S. Cl. ..... 84/383 A

(58) Field of Classification Search ..... 84/383 R, 84/383 A, 385 A, 380 R
See application file for complete search history.

(56) References Cited

U.S. PATENT DOCUMENTS 2,200,054 A * 5/1940 Bundy et al. ..... 84/383 R
3,150,554 A 9/1964 LeLoup
3,205,753 A * 9/1965 Luyben ..... 84/383 R
4,056,997 A 11/1977 Rovner
4,372,190 A 2/1983 McGuerty
5,018,425 A 5/1991 Rovner
5,289,753 A * 3/1994 Rieckhoff ..... 84/383 R
5,419,229 A 5/1995 Van Doren
5,623,111 A 4/1997 Van Doren
5,648,623 A * 7/1997 Silverstein et al. ..... 84/383 R
5,998,715 A * 12/1999 Rovner ..... 84/383 R
6,020,545 A 2/2000 Consoli

FOREIGN PATENT DOCUMENTS

DE 39 28 449 A1 3/1991

* cited by examiner

*Primary Examiner*—Kimberly Lockett
(74) *Attorney, Agent, or Firm*—Collard & Roe, P.C.

(57) ABSTRACT

The invention relates to a device for securing the single reed (2) on the mouthpiece (1) of a wind instrument, for example a clarinet or a saxophone, by which a substantially even pressure on the surface (2') of the single reed (2) and thus on the support surface (8') of the mouthpiece (2) can be achieved. The securing device comprises a ligature (3) that is placed around the mouthpiece (1) and the single reed (2), and a ligature screw (4) with a right-hand or left-hand thread (6,7) engaging with the threads of a bolt (15,15') that extends through the eyes (14,14') of the ligature (3) . The single reed (2) can be easily and securely fastened or unfastened on the mouthpiece of the musical instrument by turning the ligature screw (4).

21 Claims, 5 Drawing Sheets

DEVICE FOR SECURING THE REED ON THE MOUTHPIECE OF A MUSICAL INSTRUMENT

CROSS REFERENCE TO RELATED APPLICATIONS

Applicants claim priority under 35 U.S.C. §119 of German Application No. 100 59 752.1, filed: Nov. 30, 2000. Applicants also claim priority under 35 U.S.C. §365 of PCT/DE01/04481, filed: Nov. 30, 2001. The international application under PCT article 21(2) was not published in English.

The present invention relates to a device for securing the reed on the mouthpiece of a musical instrument, in particular with a securing device that is flexibly placed around the mouthpiece of a clarinet or a saxophone.

Such securing devices are known in the prior art from DE 39 28 449. This published document shows a mouthpiece for saxophones or clarinets that has a tubular reed that is placed on the bottom side of the mouthpiece in a flat way against the support surface of the mouthpiece, and in that way covers a window disposed within the mouthpiece. This window represents the inlet to the acoustic body of the musical instrument. Contrary to the metallic type of securing devices normally employed, the securing device by which the tubular reed is secured on the mouthpiece, is produced from a gummed linen that is tensioned and relieved again by a center screw that tensions and relieves again the entire linen sleeve. The tensioning sleeve has a width of about 7 mm, and is placed around the rod of an adjusting device. Furthermore, the adjusting device comprises a threaded bar, the one end of which is secured in one of the tensioning rods, and the other end of which is smoothly passed through a bore of another tensioning rod that is extending in parallel with the first tensioning rod. In connection with this device for securing the tubular reed on the mouthpiece of a musical instrument, it is perceived as being disadvantageous that the tensioning sleeve has a width of only about 7 mm, and that it is secured on the end of two bars. The tensioning mechanism is arranged in the center between these two bars. This tensioning mechanism connects the two bars with each other, whereby one bar comprises a threaded bore that is extending transversely to the longitudinal axis and engaging the thread of the tensioning screw. Furthermore, it is perceived as being a drawback in connection with this known securing device that at some distance from the tensioning screw, provision is made for another guide bar that is extending transversely in relation to the longitudinal axes of the tensioning rods. This has to necessarily lead to uneven tensions on the tubular reed of the mouthpiece. In addition, the technical structure of this known holding device requires a relatively considerable amount of expenditure, so that simple handling cannot be seen as being ensured.

A specific feature of the special quality of a clarinet or a saxophone in terms of its construction is the single tubular reed in the form of a striking tongue that is put into vibrations by a flow of air with the help of the human mouth. These vibrations propagate into the sound body of the musical instrument and spread there, and thus provide the musical instrument with the sound in the form of an imagined pipe.

From the time the clarinet was invented, to the instruments in use at the present time, a type of mouthpiece has developed in connection with which the tubular reed is vibrating more or less in parallel with the inner bore of the musical instrument. The inside bore of the tube of the clarinet is continuing, extending into the mouthpiece, and is feeding into the so-called outlet, where the tubular reed is clamped to the outer wall of the mouthpiece, or seated, tied-up with suitable cords, and put into vibrations by the player of the wind instrument.

The shape of a cone is generally used for the external shape of the mouthpiece, which is tapering toward the player of the wind instrument at a cone angle of about 4°. In the present case, the angle of the cone is to be understood to be the angle that is enclosed by a straight line placed through the apex of the cone and sweeping over the lead circle of the cone, and thereby produces the jacket of the cone with the axis of the cone. The external form of a possible securing device therefore has to approximately correspond with the shape of the mouthpiece so as to be able to exert on the tubular reed an even distribution of the force.

As a rule, the tubular reed is produced from a natural raw fiber material such as, for example bamboo cane, or from a suitable plastic material. Both types of mouthpiece have advantages and disadvantages, so that the practicing musician necessarily has to grapple with the correct selection of tubular reeds.

As compared with tubular reeds made of natural fiber material, tubular reeds made of plastic or composite materials do not offer the same benefits with respect to the quality of the sound and the frequency range. In particular, it is not possible to reach the upper range of the octaves the wind-player is playing through, and overtones with a very high frequency and with amplitudes with a considerable magnitude occur, which impair the musical quality wanted by a exacting musician demanding high standards. The physical reasons for these inadequacies include to some extent the relationship between the stiffness and the mass of the tubular reed, i.e. the increase in mass as compared to the rigidity along the arched external surface of the tubular reed, which is less favorable as compared to a tubular reed consisting of natural material. This results in a decrease of the response capability of the tongue, by means of which the flowing column of air vibrating in resonance in the bore of the musical instrument, is maintained in the vibrating state at each frequency. The energy of the desired partial tones therefore diminishes, while the range of the upper basic waves is limited at the same time, so that the generated tones appear to be overblown tones.

In order to bring forth the optimal quality of the sound of a musical instrument such as the clarinet or the saxophone, another precondition that needs to be satisfied is, furthermore, that the reed is secured on the mouthpiece of the musical instrument in such a manner that certain components of the vibration of the reed that have an disturbing effect on the sound of the instrument, will be avoided.

Therefore, the problem of the invention is to fasten the tubular reed of a musical instrument on the mouthpiece in such a manner that the pressure exerted on the tubular reed is uniform, and that the securing device can be handled in a simple manner.

According to the invention, this problem is resolved by the characterizing features of the independent claim. Other features that are essential to the invention are contained in the dependent claims.

The device as defined by the invention for securing the reed on the mouthpiece of a musical instrument, preferably of a clarinet or of a saxophone, with a ligature and a ligature screw that penetrates two bolts transversely in relation to the longitudinal axis, is characterized in that the ligature screw and the bolts each have right-hand and left-hand threads that engage one another. The length and the form of the ligature are dimensioned in such a way that in the combined condition, the ligature is adapted to the external shape of the reed and the jacket of the mouthpiece.

Since the overall length and the form of the ligature are a function of the circumference of the jacket of the mouthpiece, it is beneficial that the form of the layout of the ligature is adapted to the shape of the mouthpiece and the tubular reed. In connection with mouthpieces that are extending in a conical form, it is beneficial in that connection that the center line of the layout of the ligature has a defined radius (r) of its curvature.

It is beneficial, furthermore, that in connection with one embodiment of the ligature, the latter comprises two oblong recesses that are penetrated by a ligature screw when the ligature is in the joined condition.

The ligature may be advantageously realized in a double-layered form, so that by turning over the ends of the ligature in the area of the recesses in the ligature, an eye is formed through which two bolts are protruding.

In another preferred embodiment, the ligature is realized in the form of one single layer, and the ends of the ligature each comprise an eye, through which a round bolt is plugged.

It is particularly beneficial that the round bolts each comprise at least one sleeve, around which the eye of the ligature is placed. According to the invention, the sleeves have to be supported on the bolts in a rotatable manner in order to be able to exert the desired pull or pressure on the ligature or the tubular reed.

It is of a very special benefit to the present invention that the ligature screw has a right-hand and a left-hand thread for producing the mechanical tension acting on the ligature, such right- and left-hand threads engaging corresponding threaded bores in the bolts.

Furthermore, it is beneficial that the sleeves on the bolts are made of a material other than the material the bolts are made of. This, however, is not necessarily required because no major relative movements take place between the bolts and the sleeves.

Other features that are essential to the invention are contained in the dependent claims and are specified in the following detailed description.

The invention is described in the following in greater detail with the help of drawings, in which.

Figure 1:
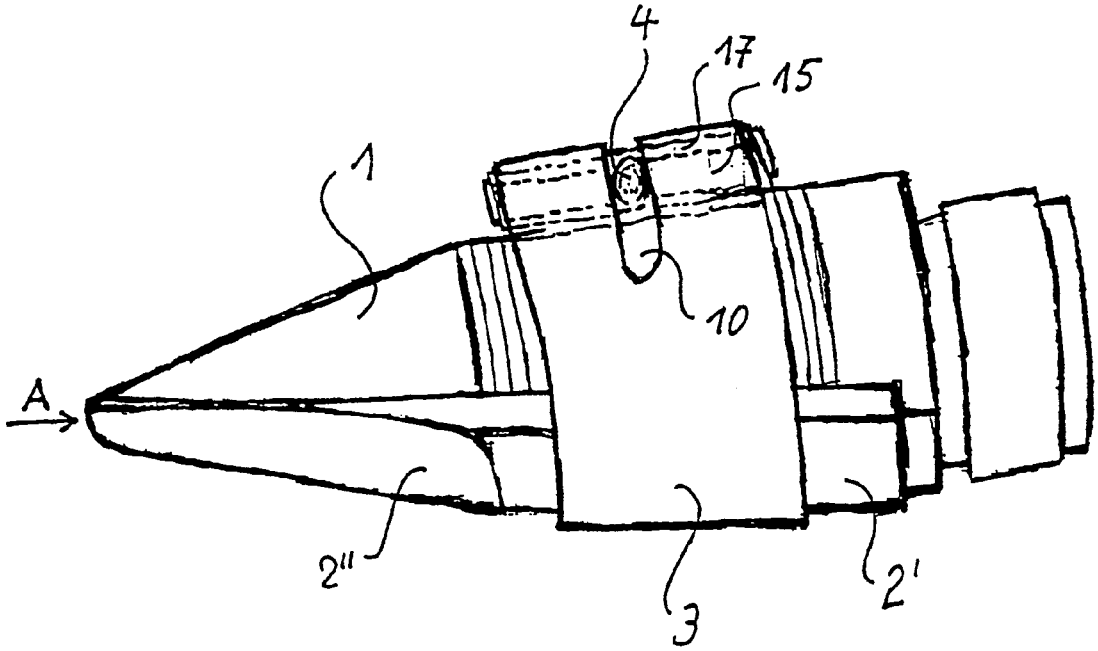
FIG. 1 is a perspective representation of a mouthpiece (1) of a wind instrument, the reed (2) of which is secured on the mouthpiece (1) of the musical instrument by means of the securing device as defined by the invention.

FIG. 1 shows a mouthpiece 1 of a wind instrument with the holding device for the reed 2 of the mouthpiece 1 as defined by the invention. This mouthpiece is suitable, for example for a clarinet or for a saxophone. The mouthpieces of such wind instruments are generally designed with a conical shape, tapering toward the opening of the mouth, i.e. they are extending in a tapered manner. In the present exemplified embodiment, the taper consists of two conical sections, which, however, is of only secondary significance for the present invention. On its support side, the reed 2 has a relatively smooth surface 8 that abuts the plane support surface 8' of the mouthpiece 1. In connection with tubular reeds 2 that consist of natural fiber materials, such as, for example a bamboo cane, the one half 2' of the reed 2 is arched on the top side, and the other half 2" of the reed 2 is beveled, so that this end of the reed is stimulated by a current of air and put into vibration. The flow of air generated by the mouth of the musician enters the sound body of the musical instrument between the housing of the mouthpiece and the tip of the tubular reed 2 in the direction indicated by the arrow A. This puts the tip of the reed into vibration. As mentioned before, it is of decisive importance to the tone color of the musical instrument that the reed 2 comes to rest on the support surface of the mouthpiece 1 in a defined manner, whereby the reed 3 encloses the arched part of the tubular reed 2, on the one hand, and the jacket of the housing of the mouthpiece 1 on the other. A suitable width of the ligature 3 can be specified as amounting to about 20 mm, which ensures an adequate tensile strength on the reed 3. The actual tensioning mechanism is described farther below. This mechanism includes in particular the ligature screw 4 as defined by the invention, with a right-hand and a left-hand thread 6, 7, that is engaging the thread bores 18, 18' of the two bolts 15, 15'. By turning the ligature screw 4 in the one or other direction, the ligature 3 can be either released or tensioned.

Figure 2:
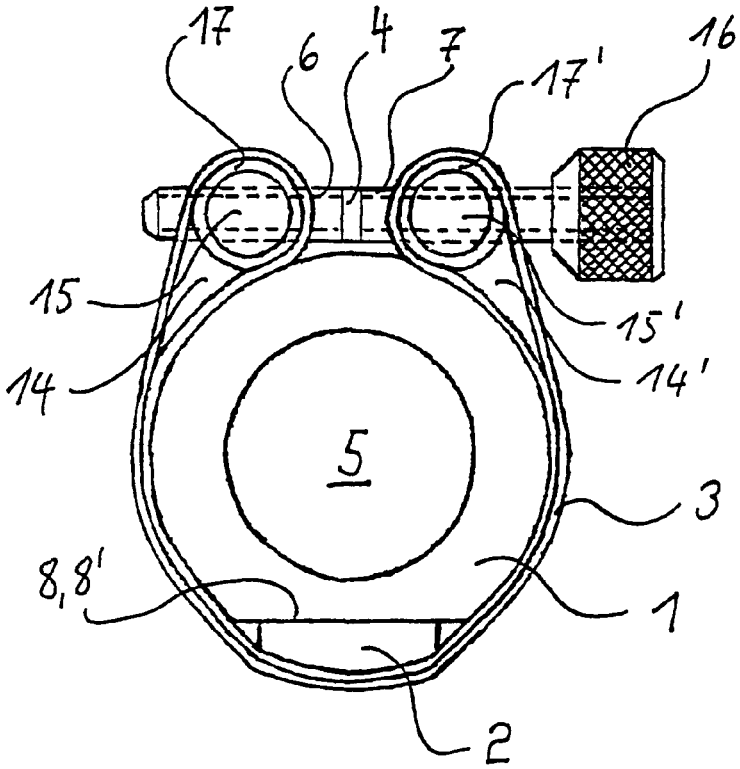
FIG. 2 is a schematic representation of the cross section of the mouthpiece, with a double-layer ligature (3) and the ligature screw (4) as defined by the invention.

FIG. 2 is a schematic view of the cross section of a mouthpiece 1 of a wind instrument 2, on which a reed 2 is secured with the help of an exemplified embodiment of a ligature 3 as defined by the invention. The cross section of the mouthpiece 1 is round, as a rule. A recess 5 is arranged in about the center of the mouthpiece; the shape of this recess differs from one mouthpiece to the other. In the present exemplified embodiment, the recess 5 is round. The support surfaces 8 and 8' of the mouthpiece and the tubular reed 2, respectively, are ground to a largely plane finish. The side of the reed disposed opposite the support surface 8 is round, as a rule, at least in connection with reeds consisting of natural fiber material, which is of significance to the invention because the ligature 3 clings to the round surface 2' in a superior way, as compared to a square surface. The ligature is double-layered and is placed around the body of the mouthpiece 1 in such a way that in connection with the present representation, the ligature 3 is forming the two eyes 14, 14'. The two bolts 15, 15', which each are inserted in at least one sleeve 17, 17', respectively, and which are supported in a rotatable manner, protrude through the openings of these eyes 14, 14'. The material of the sleeves 17, 17' is different from the one of the bolts 15, 15'. The bolts 15, 15' consist of brass, and the sleeves 17, 17', respectively, for reasons of friction, should be made from a different material, for example from aluminum. In the center, the bolts 15, 15' each comprise a threaded bore that is extending transversely in relation to the longitudinal axis of the bolts. These bores each comprise a right-hand or left-hand thread 6, 7 of the ligature screw 4. A knurled nut 16 is fastened on one end of the ligature screw 4. With this nut, the ligature screw 4 can be moved in the one or other direction for tensioning or relieving the ligature 3.

Figure 3:
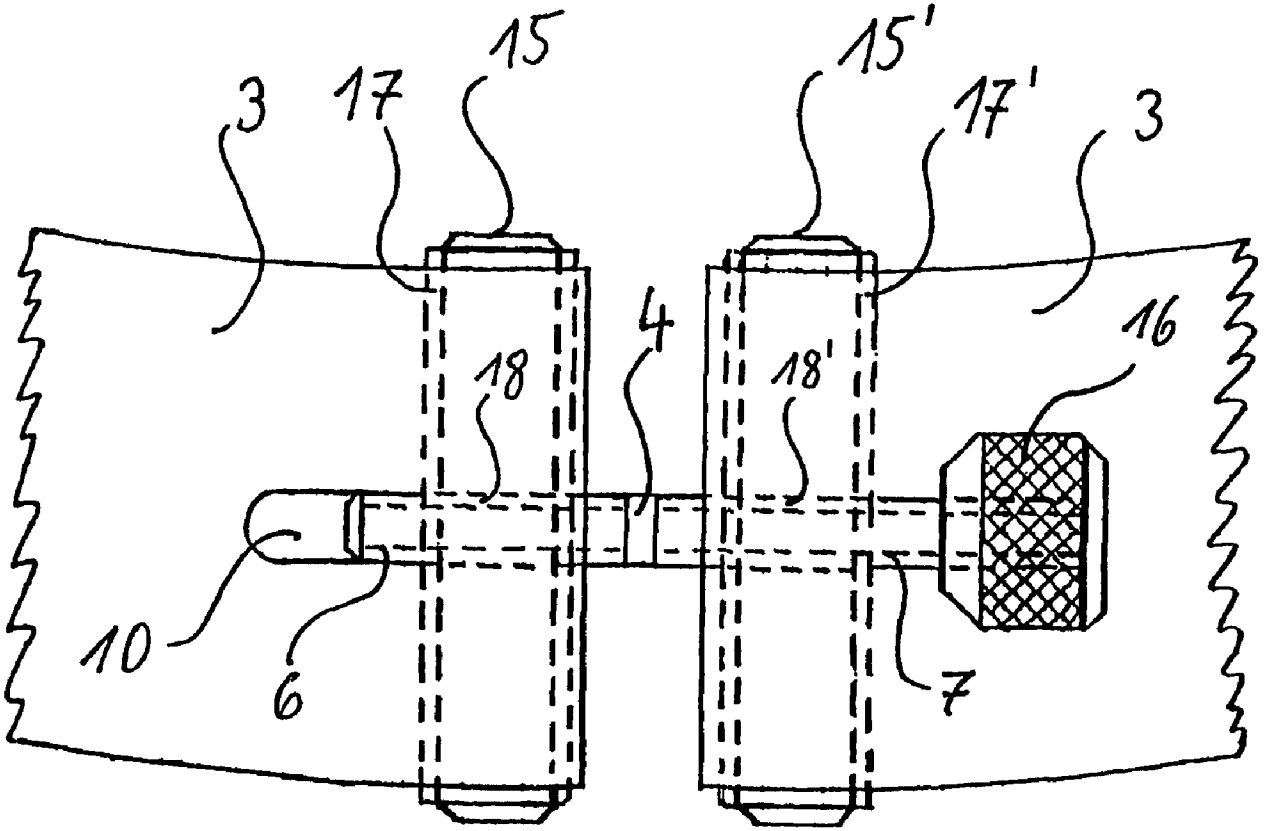
FIG. 3 is a schematic top view of the mechanical part of the securing device (1) as defined by the invention.

FIG. 3 shows a schematic top view of the mechanical part of the holding device as defined by the invention. The ligature 3 is placed around the mouthpiece 1 and the reed 2 in such a manner that it is forming an eye 14, 14', respectively, at the level of the recesses 10, 10', respectively. The recesses 10, 10' in the ligature 3 serve the purpose of allowing the ligature screw 4 to be turned without any obstruction. The two bolts 15 and 15' are inserted through the eyes 14, 14', respectively. These bolts are each accommodated in a sleeve 17, 17', respectively, The eyes 14, 14' of the ligature 3 are placed around the sleeves 17, 17', respectively, so that the sleeves perform a relative movement when the ligature 3 is tensioned or relieved, which is of decisive importance for the uniformity of the pull acting on the entire ligature. A threaded bore 18, 18' that is engaging the right-hand and left-hand thread pieces 6, 7 of the ligature screw 4, is extending through the bolts 15, 15', respectively, transversely in relation to the longitudinal axes of the bolts. The ligature screw 4 has a right-hand thread 6 and a left-hand thread 7, so that when the ligature screw 4 is turned, the center axes of the bolts 15 and 15' are displaced in parallel and in a uniform manner. The ligature 3 is tensioned or relieved in that way.

Figure 4:
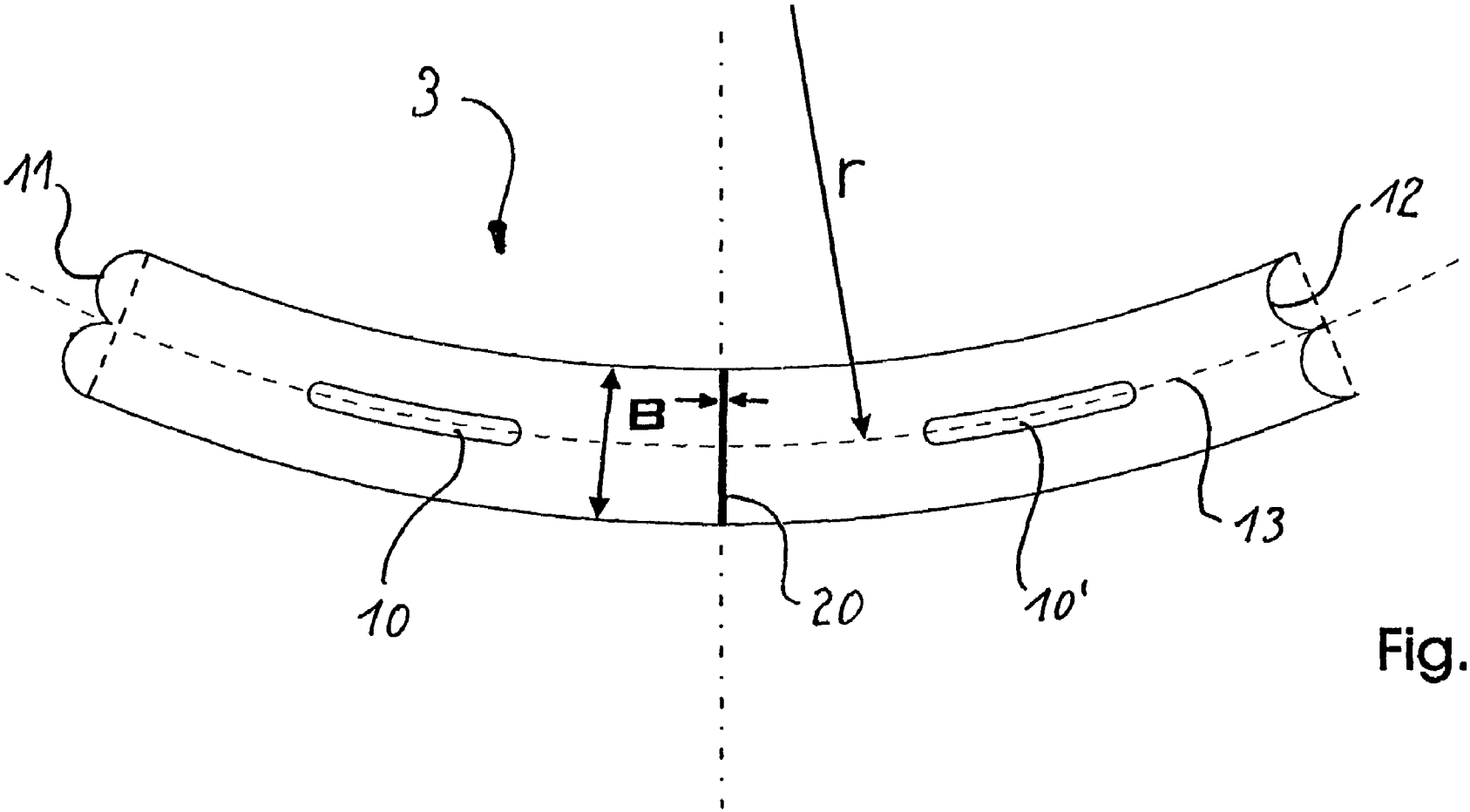
FIG. 4 is a schematic layout of a ligature (3) as defined by the invention, with a preset radius (r) of the curvature, and with two recesses (10, 10').

FIG. 4 shows the layout of the ligature 3 as defined by the invention by a schematic representation. The center line 13 of the ligature 3 is slightly curved, with a radius (r) of the curvature that is depending on the external shape of the mouthpiece 1 and the tubular reed 2. The width "B" of the ligature can be freely selected and, in the normal case, comes to approximately 20 mm. In defined sites along the centerline 13, the ligature 3 has the two recesses 10 and 10'. Their positions on the center line 13 is depending on the circumference of the mouthpiece 1. The recesses 10 and 10' serve the purpose of allowing the ligature screw 4 to extend through without obstruction. The ligature is attached at the level of the recesses 10 and 10', so that an eye 14 and 14', respectively, is formed at the level of the recesses 10 and 10', respectively. The bolts 15 and 15' protrude through these eyes with their sleeves 17 and 17', respectively. The ends of the ligature 3 can be realized in any desired form. In the present exemplified embodiment, these ends fit one another in a mirror-imaged manner in order to prevent the abutment transition from being abrupt. The dashed line at the ends 11 and 12 indicates straight ends. Of very special importance is a marking 20 that enormously helps the user (musician) in a simple manner when adjusting the reed 2, which is appreciated only by those who have had to adjust a reed 2. This marking can be realized also in the form of a notch, not shown here, located on at least one longitudinal side of the ligature 3, or in some other site. In the present exemplified embodiment, the marking 20 is realized in the form of at least one line 20 extending perpendicular to the center axis 13 of the ligature 3.

Figure 5:
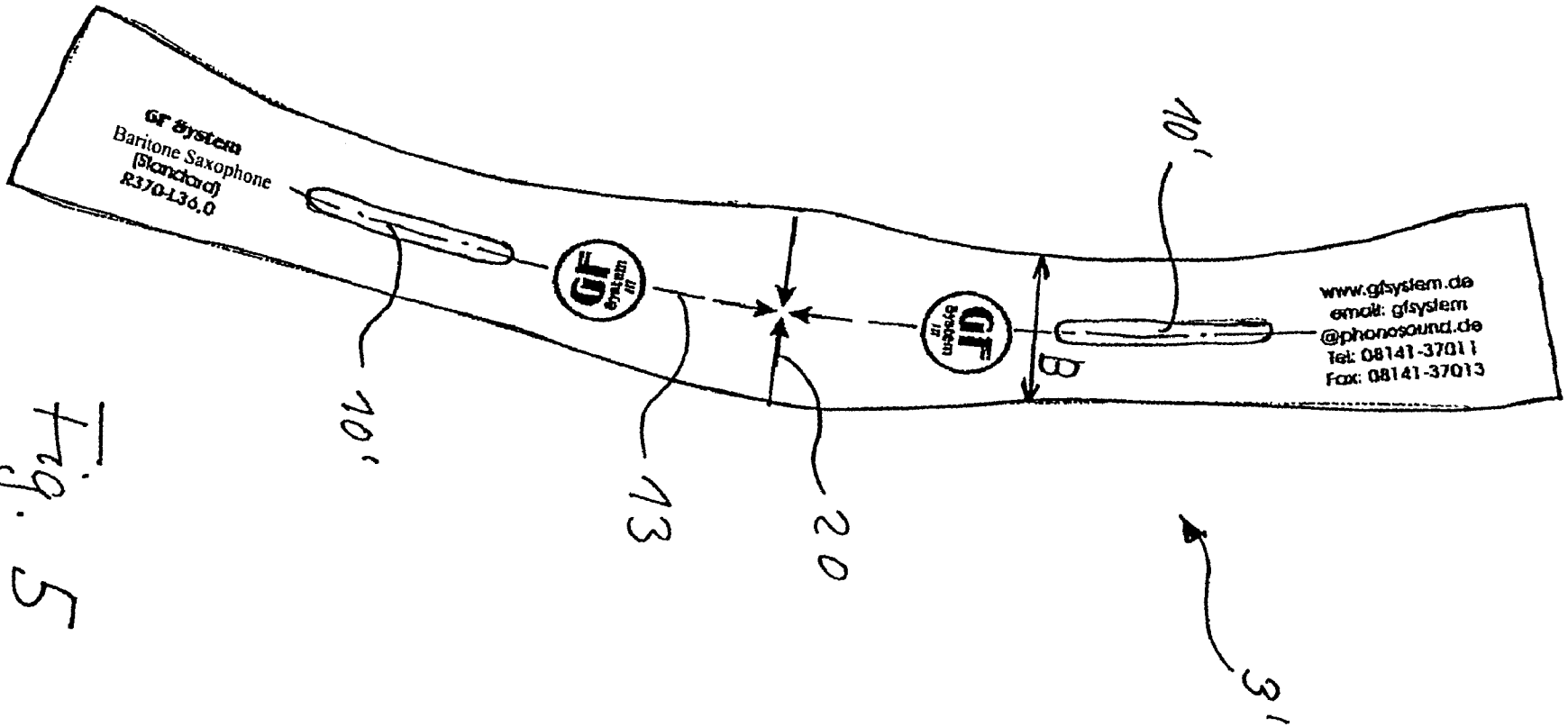
FIG. 5 is a schematic layout of an exemplified embodiment of a ligature (3') as defined by the invention, with different widths (B) along the center line (13)

FIG. 5 shows a schematic layout of an exemplified embodiment of a ligature 3' as defined by the invention, with the different widths (B) along the center line 13. The width B is not the same at all points along the center line 13, but is varying over the entire length, so that the ligature 3 has the same width at both ends and is either wider or narrower in about the center in the area of the markings 20. The effect of this variation of the width (B) of the ligature 3 is that different ligatures can be used for different instruments with the same ligature device. The ligatures are joined in the manner described in the foregoing farther above, and are welded together by a high-frequency technique. This type of joining is achieved by using as the material of the ligature a PVC material that is reinforced by a polyester fabric. Extremely thin ligatures 3 can be produced in this way, which exhibit high tearing strength, on the one hand, and favorably influence the sound of the reed on the other hand due to the low amount of mass of the ligature 3.

Figure 6:
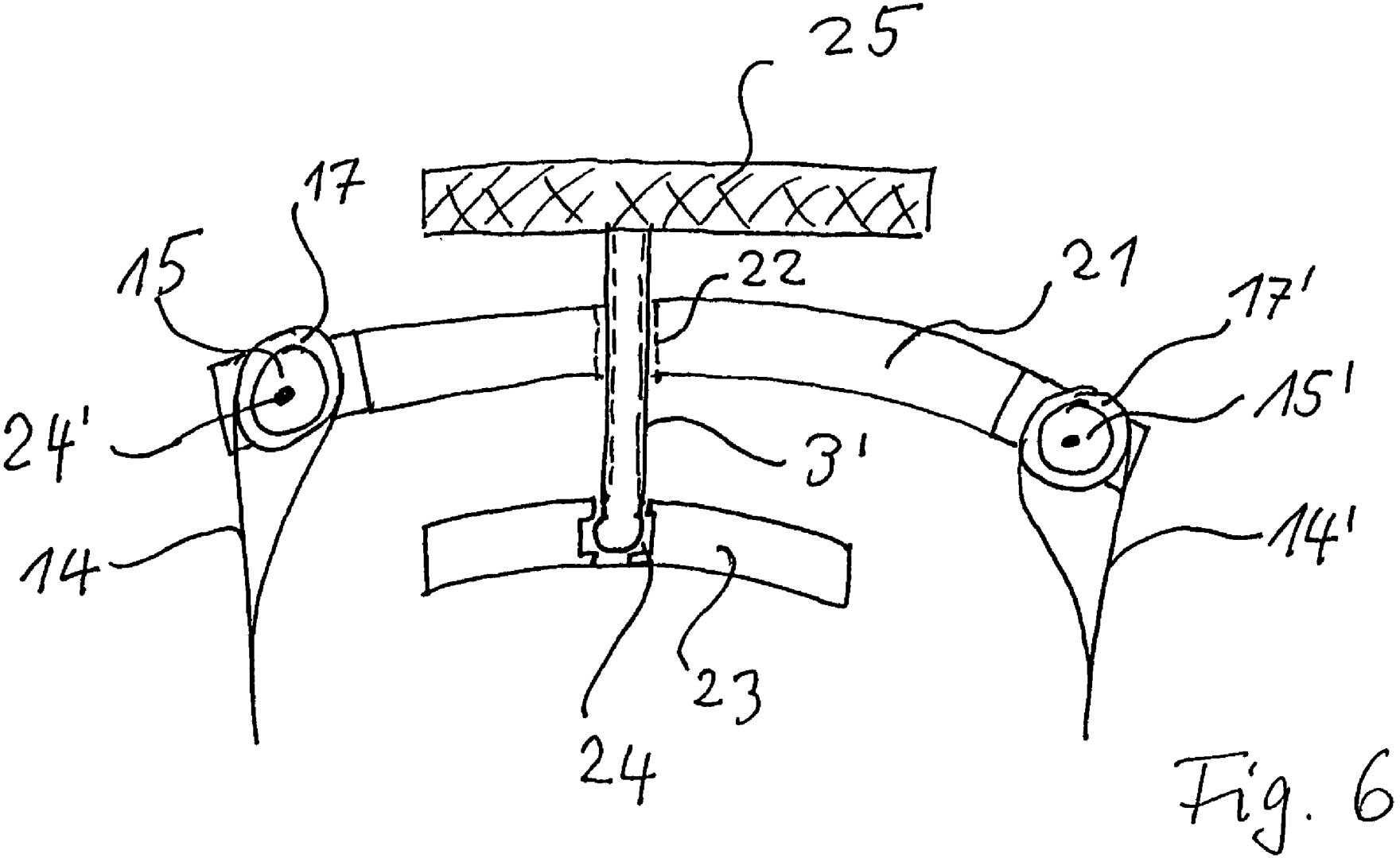
FIG. 6 is a schematic representation of another embodiment of a securing device as defined by the invention, with a carrier element (21) and a support element (23).

FIG. 6 shows a schematic representation of another exemplified embodiment of a ligature as defined by the invention that comprises a carrier element 21 and a support element 23. Viewed from the top, the carrier element 21 has an approximately rectangular shape and receives the bolts 15 and 15' laterally, with a sleeve 14, 14', respectively, being mounted on these bolts. The bolts 15 and 15' can be retained with the screws 24 or by some other fastening means. The sleeves 19 and 19' as defined by the invention are surrounded by the eyes 14 and 14', respectively, in exactly the same manner as in the first exemplified embodiment. A threaded bore 22 is arranged in about the center of the carrier element 21 and is engaging the thread 6' of the ligature screw 4. A knurled nut 25 is secured on the top end of the ligature screw 4. This nut has a diameter than can be gripped easily. The support element 23 is slightly curved with a radius of curvature that approximately corresponds with the surface of the mouthpiece 1. The support element 23, furthermore, has a recess 24 that is engaging the spherically shaped end of the ligature screw 4. It is important in connection with this type of fastening that the entire support element 23 is relatively loose and movable to all sides within defined limits. The ligature 3 is tensioned or relieved by turning the ligature 3' in or out.

The invention claimed is:

1. A device for securing a reed on a mouthpiece of a musical instrument, comprising:

a ligature with two eyes and a ligature screw, whereby said ligature is adapted to an external form of the reed and a jacket of the mouthpiece, a plurality of bolts;

a plurality of sleeves;

wherein each of the two eyes is penetrated by a bolt from said plurality of bolts and surrounded by a rotatably supported sleeve from said plurality of sleeves; and wherein said bolts each are plugged into a corresponding sleeve with a bore disposed transversely in relation to a longitudinal axis.

2. The device according to claim 1, wherein the ligature has different widths (B) along a center line.

3. The device according to claim 2, wherein the total length of the ligature is a function of a circumference and a shape of the mouthpiece.

4. The device according to claim 2, wherein a shape of a layout of the ligature is a function of a form of the jacket of the mouthpiece.

5. The device according to claim 2, wherein the center line of the ligature of a layout has a predetermined radius of curvature.

6. The device according to claim 2, wherein the ligature has at least two recesses.

7. The device according to claim 6, wherein the recesses are oblong and approximately extend along the center line of the ligature.

8. The device according to claim 1, wherein the ends of the ligature are designed in such a way that they fit together in a mirror-imaged manner.

9. The device according to claim 1, wherein the ligature screw has a rotary knob at least at one end.

10. The device according to claim 1, wherein the sleeves are enclosed by the eyes of the ligature.

11. The device according to claim 1,
wherein the sleeves are made of a material other than the material of the bolts.

12. The device according to claim 1,
wherein an outer side and/or the inner side of the ligature has an imprint.

13. The device according to claim 1,
wherein the ligature has a marking as an adjustment aid.

14. The device according to claim 1,
wherein the ligature has a notch as a marking in at least one longitudinal side.

15. The device according to claim 1,
wherein a marking is imprinted as a line on the external side of the ligature.

16. A device for securing a reed on a mouthpiece of a musical instrument, comprising:
a ligature with two eyes; and
a ligature screw, that is adapted to receive an external form of the reed and a jacket of the mouthpiece,
a plurality of bolts;
a plurality of sleeves;
wherein each of the two eyes is penetrated by a bolt from said plurality of bolts, and surrounded by a rotatably supported sleeve from said plurality of sleeves; and
wherein the ligature is double-layered and the layers are welded together by means of a high-frequency technique.

17. A device for securing a reed on a mouthpiece of a musical instrument, comprising:
a ligature with two eyes; and
a ligature screw, whereby a form of the ligature is adapted to receive an external form of the reed and a jacket of the mouthpiece,
a plurality of bolts;
a plurality of sleeves;
wherein each of the two eyes is penetrated by a bolt from said plurality of bolts, and surrounded by a rotatably supported sleeve from said plurality of sleeves; and wherein material of the ligature consists of PVC with a very thin polyester fabric, and that thickness of the material amounts to about 1 mm.

18. A device for securing a reed on a mouthpiece of a musical instrument, comprising:
a ligature with two eyes; and
a ligature screw, whereby a form of the ligature is adapted to receive an external form of the reed and a jacket of the mouthpiece,
a plurality of bolts;
a plurality of sleeves;
wherein each of the two eyes is penetrated by a bolt from said plurality of bolts and surrounded by a rotatably supported sleeve from said plurality of sleeves; and
wherein the bolts are arranged laterally of a carrier element.

19. A device for securing a reed on a mouthpiece of a musical instrument comprising:
a ligature with two eyes; and
a ligature screw, which is adapted to receive an external form of the reed and a jacket of the mouthpiece,
a plurality of bolts;
a plurality of sleeves;
wherein each of said two eyes is penetrated by a bolt from said plurality of bolts, and surrounded by a corresponding rotatably supported sleeve from said plurality of sleeves; and wherein the bolts are arranged laterally of a carrier element; and wherein the carrier element has a threaded bore engaging the ligature screw.

20. A device for securing a reed on a mouthpiece of a musical instrument, comprising:
a ligature with two eyes; and
a ligature screw, that is adapted to receive an external form of the reed and a jacket of the mouthpiece,
a plurality of bolts;
a plurality of sleeves;
wherein each of the two eyes is penetrated by a bolt from said plurality of bolts and surrounded by a rotatably supported sleeve from said plurality of sleeves; and wherein the bolts are arranged laterally of a carrier element; and
wherein a support element is arranged on the end of the ligature screw, said support element being loosely fastened on the end of the ligature screw.

21. A device for securing a reed on a mouthpiece of a musical instrument, comprising:
a ligature with two eyes; and
a plurality of bolts;
a plurality of sleeves;
a ligature screw, that is adapted to receive an external form of the reed and a jacket of the mouthpiece,
wherein each of the two eyes is penetrated by a bolt from said plurality of bolts; and surrounded by a rotatably supported sleeve from said plurality of sleeves; and wherein the bolts are arranged laterally of a carrier element; and
wherein the end of the ligature screw is shaped spherically and engages a recess in about the center of the support element.

* * * * *